United States Patent [19]

Bayham

[11] 4,213,561

[45] Jul. 22, 1980

[54] FLEXIBLE, COLLAPSIBLE CONTAINER FOR BLOOD AND THE LIKE WHICH IS FREE OF LIQUID-TRAPPING FOLDS

[75] Inventor: Edward L. Bayham, Mundelein, Ill.

[73] Assignee: Baxter Travenol Laboratories, Inc., Deerfield, Ill.

[21] Appl. No.: 937,008

[22] Filed: Aug. 25, 1978

[51] Int. Cl.[2] ..... B04B 7/00; B65D 29/00

[52] U.S. Cl. ..... 233/14 R; 150/0.5; 233/26

[58] Field of Search ..... 150/0.5, 8; 233/14 R, 233/26, 27

[56] References Cited

U.S. PATENT DOCUMENTS

| | | | |
|---|---|---|---|
| D. 243,121 | 1/1977 | Ralston | 150/0.5 |
| 3,190,546 | 6/1965 | Raccuglia et al. | 233/26 X |
| 3,312,221 | 4/1967 | Overment | 150/0.5 |
| 3,672,564 | 6/1972 | Schlutz et al. | 233/26 |
| 3,674,197 | 7/1972 | Mitchell et al. | 233/26 |
| 4,098,456 | 7/1978 | Bayham | 233/26 X |

FOREIGN PATENT DOCUMENTS

| | | | |
|---|---|---|---|
| 979077 | 12/1950 | France | 150/0.5 |
| 910217 | 11/1962 | United Kingdom | 150/0.5 |

*Primary Examiner*—Stephen P. Garbe

*Attorney, Agent, or Firm*—Henry W. Collins; Paul C. Flattery; Garrettson Ellis

[57] ABSTRACT

An elongated, flat-sealed flexible, collapsible container comprises a pair of facing plastic walls and a peripheral, annular heat seal joining the walls together. Access ports are positioned at one end of the container. In accordance with this invention, the peripheral heat seal defines at the end opposite to the one end a first, straight end seal section extending generally perpendicularly to the longitudinal axis of the container, and a pair of second, straight end seal sections extending from adjacent each end of the first end seal section and defining an obtuse angle to it. The container, when filled and placed in a centrifuge cup, tends to form inwardly-extending creases in the second end seal sections which do not trap portions of the contents of the container.

9 Claims, 2 Drawing Figures

FLEXIBLE, COLLAPSIBLE CONTAINER FOR BLOOD AND THE LIKE WHICH IS FREE OF LIQUID-TRAPPING FOLDS

BACKGROUND OF THE INVENTION

Blood bags are almost universally used for blood collection and storage. They are generally flat-sealed plastic sheets defining a peripheral annular heat seal joining the plastic sheets together into bag walls. Upon filling, the bags of course expand outwardly from their flat-sealed configuration.

When many types of blood bags are placed in a standard centrifuge container, the bottom of the bag is folded within the container. Often, the corners of the blood bags fold around to form closed pockets of fluid which cannot mix with the main body of fluid during centrifugation.

In accordance with this invention, the new contour exhibited by the bag of this invention provides inward folds at predetermined locations when the bag is placed within a centrifuge cup. Furthermore, the inward folds which typically are formed with the bag of this invention during centrifugation are open in nature and do not entrap fluid during the centrifuging operation. Accordingly, better processing of the contents of the bag, for example, for separating plasma from packed cells, may be achieved on a routine basis.

BRIEF DESCRIPTION OF THE INVENTION

In accordance with this invention, an elongated, flat-sealed, flexible, collapsible container is provided which comprises a pair of facing plastic walls and a peripheral, annular heat seal joining the walls together. Access port means are positioned at one end of the container.

In accordance with this invention, the peripheral seal defines, at the end opposite to the one end of the container, a first, straight end seal section extending generally perpendicularly to the longitudinal axis of the container, and a pair of second, straight end seal sections extending from adjacent each end of the first end seal section and defining an obtuse angle to it. Accordingly, the container of this invention, when filled and placed in a centrifuge, tends to form inwardly-extending creases located in the second end seal sections, which creases do not trap portions of the contents of the container.

It is generally preferred for the obtuse angle between the first and second end seal sections to be from about 120° to 160° for optimum performance in the formation of the desired, non-isolating creases when the bag of this invention is placed in a standard blood centrifuge cup.

In the illustrative embodiment, the container may flare outwardly from the one end which carries the axis ports toward the opposite end to a point adjacent the second end seal sections. Thereafter, the bag may curve inwardly with a smooth, elongated curve extending a distance on the order of an inch, followed by each second straight end seal section.

The peripheral heat seal line preferably forms an abrupt angle at the junction between the first and second end seal sections.

DETAILED DESCRIPTION OF THE ILLUSTRATIVE EMBODIMENT

Figure 1:
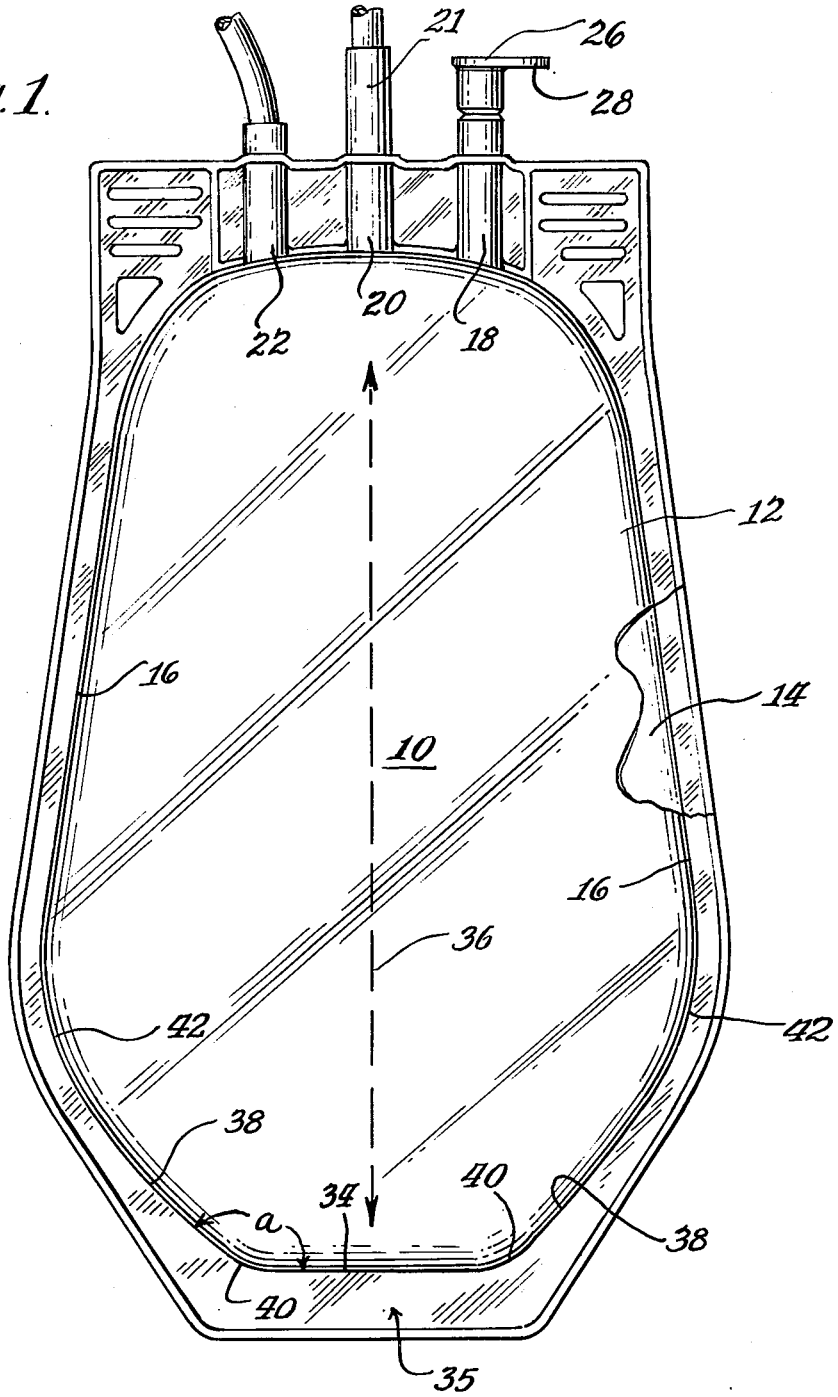
FIG. 1 is a plan view of a blood bag made in accordance with this invention, with a portion broken away.

Referring to the drawings, blood bag 10 is shown to be made from a pair of facing plastic walls 12, 14 which are sealed together with a peripheral, annular heat seal line 16 joining walls 12, 14 together.

Various access ports 18, 20, 22 are provided as desired, passing through the peripheral heat seal in conventional manner. For example, access port 22 communicates with donor tubing 24 for receiving blood into the bag.

Port 18 may be sealed in a sterile manner with tear seal member 26, which includes a tear handle 28 for manually removing by tearing of a tear top across the outer face of access port 18. Access port 18 provides access to the contents of the bag by means of an appropriately designed blood set, which penetrates a diaphragm in conventional manner in the access port 18.

Access port 20 or tubing 21 may contain a conventional internally positioned valve member to control flow therethrough. Tubing 21 may, if desired, communicate with another blood bag as is generally conventional to provide a sealed multiple bag system. If bag 10 is intended for use as a single bag, port 20, tubing 21, and associated parts may be omitted.

In accordance with this invention, peripheral heat seal 16 defines, at the end opposite to the one end which carries the access ports, a first straight end seal section 34, which extends generally perpendicularly to the longitudinal axis 36 of the container.

A pair of second, straight end seal sections 38 extend from adjacent each end of the first end seal section 34, being joined thereto by a relatively short section 40 of peripheral seal 16. Second end seal sections define an obtuse angle a of preferably about 120° to 160° to the first end seal section 34. An obtuse angle a of 133° has been found to provide excellent characteristics. The other ends of second straight end seal sections 38 are integral with a curved portion 42 of the peripheral heat seal 16, which may be approximately one inch long.

Container 10 may flare outwardly from the end which defines the access ports toward the opposite end 35 which carries seal section 34, terminating at a point adjacent the second end seal section 38 where curved portion 42 is encountered.

Alternatively, container 10 may exhibit straight sides and not flare outwardly.

Figure 2:
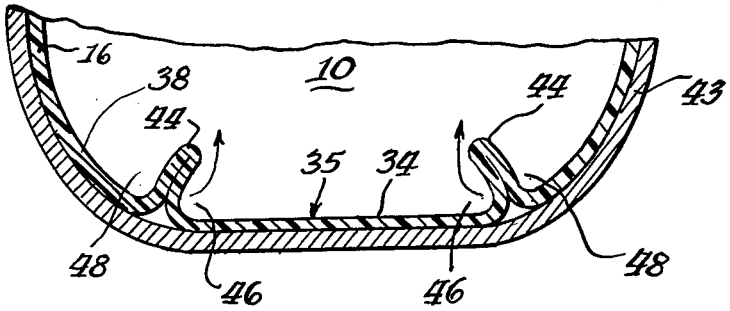
FIG. 2 is a fragmentary cross-sectional view of the blood bag of FIG. 1 in a centrifuge cup.

As illustrated in FIG. 2, when the container 10 of this invention is filled with blood or other liquid, and placed in a standard centrifuge cup 43, the opposite end 35 generally folds up with a pair of creases 44 to accommodate the centrifuge cup. As can be seen, creases 44 point in a direction which has a substantial axial extent so that the sections 46, 48 on either side of the creases are not closed off from the main portion of container 10. Accordingly, the entire contents of container 10 are subject to the mixing during the centrifuging action so that all of the contents are separated.

The above has been offered for illustrative purposes only, and is not intended to limit the invention of this application, which is as defined in the claims below.

That which is claimed is:

1. In a blood centrifuge system including a centrifuge cup and an elongated, liquid-filled, flat-sealed, flexible, collapsible container positioned within said cup for centrifugation of the liquid in said container, said liquid-filled container within said cup being of essentially the same transverse dimension as said container, said container defining access port means at the end of the container facing outwardly from said centrifuge cup, the improvement comprising, in combination: the inward end opposite to said outwardly-facing end of the container, positioned within said centrifuge cup, defining a first, central end section extending generally perpendicularly to the longitudinal axis of said container, and a pair of second, generally straight end sections, extending from adjacent each end of the first end section and defining obtuse angles to it, said container further defining within said centrifuge cup a pair of inwardly-extending creases located adjacent the ends of said first end section which creases do not trap portions of the contents of said container, said inward end being free of apertures leading to the exterior.

2. The blood centrifuge system of claim 1 in which the junctions between the ends of the second end sections remote from said first end section and the remainder of the container periphery define rounded, curved portions.

3. The blood centrifuge system of claim 1 in which said container flares outwardly from said outwardly-facing end toward said inward end to a point adjacent said second end section.

4. The container of claim 1 in which said obtuse angle is from 120° to 160°.

5. The container of claim 4 in which said obtuse angle is about 133°.

6. In a blood centrifuge system including a centrifuge cup and an elongated, liquid-filled, flat-sealed, flexible, collapsible container positioned within said cup for centrifugation of the liquid in said container, said liquid-filled container being essentially of the same transverse dimensions as said centrifuge cup, said container defining access port means positioned at one end of said container facing outwardly from said centrifuge cup, the improvement comprising, in combination: the inward end opposite to said outwardly-facing end of the container, positioned within said centrifuge cup, defining a first, central end section extending generally perpendicularly to the longitudinal axis of said container, and a pair of second, generally straight end sections, extending from adjacent each end of the first end section and defining obtuse angles of 120° to 160° to it, said container flaring outwardly from said outwardly-facing end toward the inward end to a point adjacent said second end sections, said container further defining within said centrifuge cup a pair of inwardly extending creases located adjacent the ends of said first end section, which creases do not trap portions of the contents of said container, said inward end being free of apertures leading to the exterior.

7. The blood centrifuge system of claim 6 in which said container comprises a pair of facing plastic walls, and a peripheral heat seal joining said facing plastic walls together.

8. The blood centrifuge system of claim 6 in which the junctions between the ends of the second end sections remote from said first end section and the remainder of the container periphery define rounded, curved portions.

9. The container of claim 6 in which said obtuse angle is about 133°.

* * * * *